United States Patent [19]

Dardick

[11] 4,204,473

[45] May 27, 1980

[54] GAS GENERATING CHARGE FOR OPEN CHAMBER GAS POWERED TOOL

[76] Inventor: David Dardick, 211 E. 70th St., New York, N.Y. 10021

[21] Appl. No.: 906,784

[22] Filed: May 17, 1978

Related U.S. Application Data

[63] Continuation-in-part of Ser. No. 738,953, Nov. 4, 1976, which is a continuation-in-part of Ser. No. 570,909, Apr. 23, 1975, Pat. No. 4,026,212, which is a continuation of Ser. No. 359,754, May 14, 1973, abandoned.

[51] Int. Cl.[2] ..... F42B 3/04

[52] U.S. Cl. ..... 102/39; 102/99

[58] Field of Search ..... 102/38 R, 38 NC, 38 CC, 102/40, DIG. 5, 99–103; 263/3 R; 149/2, 96; 227/11

[56] References Cited

U.S. PATENT DOCUMENTS

| | | | |
|---|---|---|---|
| 3,280,746 | 10/1966 | Brown | 102/DIG. 5 |
| 3,424,087 | 1/1969 | Hintze | 102/39 |
| 3,514,026 | 5/1970 | Dardick | 227/11 |
| 3,563,177 | 2/1971 | Ritchey | 102/38 R |
| 3,938,440 | 2/1976 | Dooley et al. | 102/38 |
| 4,091,730 | 5/1978 | Dardick | 102/39 |

*Primary Examiner*—Harold J. Tudor
*Attorney, Agent, or Firm*—Alfred B. Levine

[57] ABSTRACT

An ignitable charge for producing pressurized gas to power industrial tools; that is made of plentiful, common materials at a very low cost, lower in cost than conventional charges by orders of magnitude. The charge is comprised of a hollow plastic jacket of triangular cross section that is open through its center to both opposite ends and contains a nitrocellulose propellant in uncompressed, or expanded form that may be electrically ignited through one end of the jacket by a spark, hot wire, or the like in an open chambertype feed and firing mechanism. The charge produces pressurized gas at the desired burning rate and peak pressures for operating the tool.

11 Claims, 9 Drawing Figures

GAS GENERATING CHARGE FOR OPEN CHAMBER GAS POWERED TOOL

CROSS-REFERENCE TO RELATED PATENT APPLICATIONS

This application is a continuation-in-part of pending application Ser. No. 738,953, filed Nov. 4, 1976; which, in turn, is a continuation-in-part of pending application Ser. No. 570,909, filed Apr. 23, 1975, now U.S. Pat. No. 4,026,212, that is a continuation of Ser. No. 359,754, filed May 14, 1973 and now abandoned.

BACKGROUND AND PRIOR ART

This invention relates to ignitable gas generating charges for powering tools for home and industry, and more particularly is concerned with a charge for an open chamber gas powered tool, such as a fastener driving tool for driving nails, studs and the like into workpieces.

Propellant gas powered fastener driving tools are well known in the art. One class of such tools fires fasteners, such as studs, directly into a workpiece at high velocity in much the same way as a gun fires a bullet into a target. Another class of tools for driving fasteners are gas powered percussion tools. These tools have a breech mechanism for firing gas generating charges, and a plunger which is propelled through a working stroke by the gas generated by each fired charge. The driven plunger in the tool is, in turn, utilized to drive a fastener, such as a nail or stud; or to deliver an impact to a workpiece; or to perform some other work operation. Examples of gas powered percussion tools are disclosed in earlier patents of the present inventor, including U.S. Pat. Nos. 3,514,026 and 3,283,657; as well as British Pat. Nos. 1,036,224 and 1,074,195.

The present inventor is the originator of the "open chamber" type of weapon and gas percussion tool as is disclosed in his U.S. Pat. No. 3,514,026. This tool provides for a "repeater" type of action, wherein a succession of open chamber charges are successively fed into the firing chamber and each is ignited to actuate the tool for one cycle of operation. This patented tool is relatively simple to construct and operate and may be manufactured at relatively low cost, yet provides the "repeater" action that is not only labor saving over the "single shot" tools of the prior art but permits a wide variety of high production rate uses, such as driving fasteners in the building construction trades.

However, one of the most serious problems applicable to all presently available types of ignition type gas powered fastener driving tools is the relatively high cost of the gas generating charges. A conventional type of gas generating cartridge that is presently in use in conventional "closed chamber" types of tools commonly sells for about 6 cents to 8 cents for each cartridge, despite the fact that such cartridges are purchased in large quantities by the construction building trades. One of the reasons for this high cost is the cost of manufacturing the conventional types of closed end metal casings. Another, is the relatively high cost of producing the gunpowder propellant, presently selling for about 75 cents per pound in barrels weighing 100 pounds.

As a result of the high cost of the cartridges, ignitable types of gas generating driven tools are primarily limited for use at present to various industrial purposes only, such as for driving studs into concrete and the like, where the high cost of the cartridges is economically justified for that particular industrial application.

To reduce the high costs of processed propellant for both gun and tools uses, various kinds of less expensive propellants have been attemped in the past. For example, in the 1870's, ordinary gun cotton in natural fibrous form was used in closed cartridges for rifles. However, this material was soon abandoned because of its excessively high burning rate that produced excessive peak pressures that often ruptured the gun barrels. To reduce this too rapid burn rate, the gun cotton fibres were at a later time compressed into solid shapes and pellets, to reduce the excessive surface burning area and accordingly reduce the excessive peak burning pressures. However, this practice made it difficult to ignite the compressed material, necessitating the use of a primer explosive to break up the compressed material and ignite the then expanded material.

In a still later in time evolutionary step, the gun cotton fibres were combined with various binder materials to provide structural integrity and to permit control of the burning rates and peak burning pressures. However it was found to be difficult to obtain uniform ballistic performance by this type of binder processing, and the costs of producing this propellant was considerably increased due to the processing steps. A primer explosive was also required to break up the solidified propellant in the binder and permit ignition.

In still later in time methods of making propellant, the gun cotton, or mitrocellulose obtained from other vegetable fibres, was ground into particles of uniform size and colloidally suspended in suitable binders that were molded or extruded into shaped charges or small "grains". This process, of course, provided the virtue of insuring uniformity of the charges, and of permitting the process to yield propellant charges of controlled and uniform burning characteristics and pressures. According, variations of this manner of making propellants have been used up to and including the present time. However, in order to obtain these controlled burning characteristics and uniformity, the processing cost of producing this propellant is relatively high, and the cartridges or charges also necessitate the use of a built-in or combined primer charge for breaking apart the propellant and igniting the particles.

Thus it is seen that gun cotton, or other nitrocellulose product, in the form of relatively loose fibres or otherwise expanded, was discontinued for use as a propellant over one hundred years ago, because of its too rapid burning and too high peak pressure. Its use at later periods of time was in a more expensive to produce processed form; either colloidally suspended in a binder and molded or shaped; or compressed in the form of compacted particles with a combined primer charge; or otherwise processed in such manner as to control its too rapid rate of burning and peak pressures.

In the prior art specifically concerned with ignition type gas pressure producing charges for tools, efforts have been made to use caseless charges employing pelletized gun cotton (compressed particles) containing a primer explosive to break up the pellet and ignite the particles. However such charges were found to be relatively expensive as discussed above, as well as not uniform in ignition, and to leave a residue after burning.

Additionally, efforts have been made to reduce the high cost of cartridges by employing conventional closed cylindrical cartridge cases of plastic instead of metal. However, these efforts were discontinued for the most part due to the difficulty of removing the cases after firing as a result of excessive deformation of the plastic walls.

Still further efforts have been made to use liquid propellants to power such tools. However this has been found to greatly increase the cost of the tool; requiring the provision of added mechanism for storing, metering, and igniting the liquid propellant.

SUMMARY OF THE INVENTION

According to the present invention, there is provided an improved gas generating charge for powering industrial tools that is considerably less expensive to produce than those of the prior art. In brief, the charge is simply comprised of an open chamber type of hollow plastic jacket or case that is open ended, or more specifically having a central opening passing entirely through the jacket from end-to-end. Within the central opening of the jacket is provided a propellant of nitrocellulose in its more natural, expanded form of fibres. Since the propellant is not tightly compressed or combined with a binder, it requires no primer explosive to break up and ignite, but instead it is easily ignited by a separate spark or electrical igniter, either hot wire or spark, that may be provided as a built-in part of the firing chamber of the tool.

Because of the open-ended construction of the triangular jacket or case, as combined with the characteristics of the "open chamber" construction of the tool, the excessive peak pressure that were heretofore generated by loose gun cotton, or loose nitrocellulose fibres or particles in a closed end cartridge, are considerably lowered. As a result, the cost of this charge is vastly reduced by the use of substantially unprocessed nitrocellulose fibres instead of processed gunpowder, to a level in the range of less than two cents a charge, as compared to over six cents a charge for conventional gunpowder charges in a conventional closed metal case.

DESCRIPTION OF THE PREFERRED EMBODIMENTS

Figure 1:
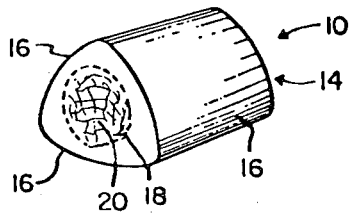
FIG. 1 is a perspective view of a gas generating charge according to the invention.
Figure 2:
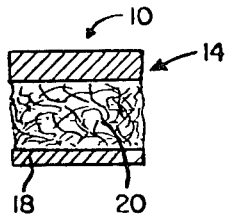
FIG. 2 is a longitudinal section through the charge.
Figure 7:
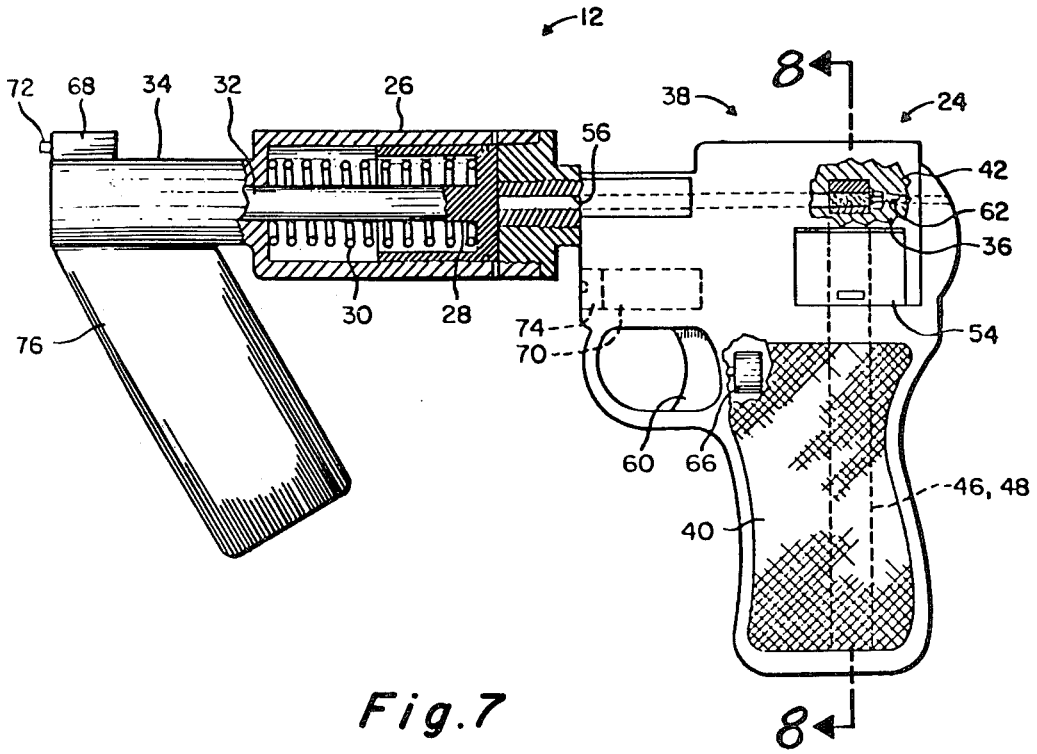
FIG. 7 illustrates a gas powered tool according to the invention.
Figure 8:
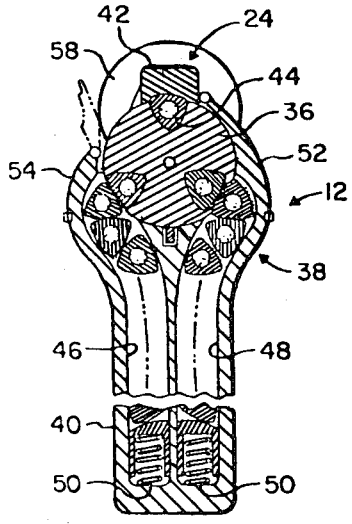
FIG. 8 is a section taken on a line 8—8 in FIG. 7.
Figure 9:
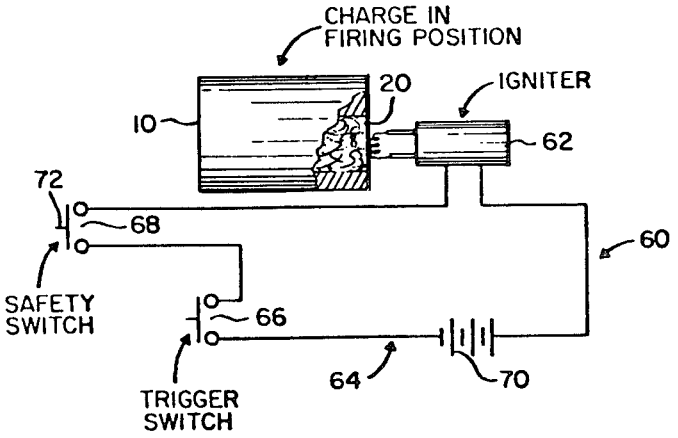
FIG. 9 illustrates one firing means for the tool.

FIGS. 1 and 2 illustrate an open chamber gas generating charge 10 according to the invention for the gas powered open chamber tool 12 of FIGS. 7 through 9. Charge 10 has an outer hollow plastic jacket 14 of uniform non-circular cross-section suitable for an open chamber breech action. In this instance, the jacket has the preferred generally equilateral triangular cross-section described in the above mentioned patents and includes three side walls 16 which are externally cylindrically curved to the same radius. As will appear from the ensuiing description, however, an open charge according to the invention may have any other cross-section suitable for an open chamber breech action.

Figure 6:
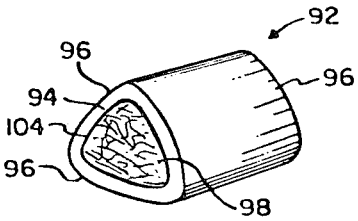
FIG. 6 is a perspective view of a modified charge.

Extending longitudinally through the jacket 14, on its central longitudinal axis is a propellant chamber 18. The illustrated chamber is circular in cross-section, although the chamber may be triangular in cross-section as shown in FIG. 6, or have any other desired cross-section. Propellant chamber 18 opens through the ends of the jacket 14, as illustrated. Filling the propellant chamber is a propellant 20, such as substantially uncompressed nitrocellulose fibres.

The open ends of the propellant chamber 18 may be left uncovered. However, the chamber ends may be covered by combustible seals of paper or other flammable material which are adhesively bonded or otherwise secured to the ends of the jacket 14, as is described in copending application Ser. No. 570,909, referred to above.

As generally discussed above, it is an objective of the present invention to provide a propellant charge at the lowest possible cost, that is made of inexpensive materials that are available in plentiful supply. These objectives are obtained by preferably employing an outer jacket or casing 10 made of inexpensive plastic material that can be rapidly formed in large quantity by extruding its cross-section lengthwise in long lengths and transversely cutting the individual units. For the propellant, it is preferred to employ substantially noncompressed, or lightly compressed, nitrated nitrocellulose fibrous material, that may include ordinary gun cotton fibres, as discussed above, whose use was abandoned in the 1800's; as well as many other plentiful, available kinds of vegetable fibres that can be similarly treated by known chemical nitrating processes so as to be as highly inflammable, in the manner of gun cotton. Such natural fibrous cellulostic material is readily available in plentiful supply throughout the world, at a cost that is but a small fraction of the present cost of processed gun powder of the kinds conventionally used for propellant charges.

As is well known, such fibres, when dry and only loosely compressed provide an extremely large surface area exposed to air and are therefore highly inflammable. In fact, the extremely high rate of burning and correspondingly high peak pressures produced by burning such loose gun cotton was the very reasons for discontinuing its use as a propellant in conventional closed end type cartridges, since such early use resulted in fracturing and cracking of gun barrels as discussed above. However, according to the present invention, the fact that the jackets 10 of the charges are open at both ends, rather than closed at one end like a conventional cartridge case; and the fact that such charges are employed in an open firing chamber instead of a conventional closed chamber enables this very inexpensive and plentiful propellant to be used whereas in the more conventionally available guns and tools it could not be used with safety.

Additionally, as will be described, the substantially uncompressed form of the propellant enables it to be ignited, without a primer, by means of an easily generated spark, hot wire, or arc produced within the tool in the firing chamber. The elimination of the need for an explosive primer and the simplification of the igniting mechanism, further reduces the cost of both the charge and of the driving tool enhancing its economic utility for both industrial and home tool uses.

As will be appreciated by those skilled in the propellant arts, the mass or total quantity of fibres provided in the propellant charge determines its total energy and heat content available upon combustion; whereas the degree of compression of the fibres 20 within the opening of jacket 10 determines the burnable surface area, and accordingly the rate of burning and peak pressures produced. Accordingly, both the mass of the propellant 20 used in the charge as well as the degree of its compression or looseness will be varied to some extent depending upon the size of the tool and driven element, as well as the nature and material of the workpiece. However, as will be appreciated from the foregoing, the propellant will always be employed in relatively uncompressed or lightly compressed form that is ignitable by a separately produced spark or hot wire, thereby to employ the combined best characteristics of the open chamber type tool together with the inexpensive cost of the fibrous nitrocellulose propellant and triangular "open chamber" plastic jacket.

As noted above, the gas generating charge 10 is adapted for use in the open chamber gas powered tool 12 of FIGS. 7 through 9. Except for the charge firing means and a fastener magazine embodied in the tool 12, the latter is identical to that described in my earlier mentioned U.S. Pat. No. 3,514,026 which, as noted in the latter patent, embodies a breech mechanism like that of my prior U.S. Pat. No. 2,865,126. Accordingly, it is unnecessary to describe the tool 12 in elaborate detail.

Suffice it to say that the tool has a rear open chamber breech mechanism 24 in which the charges 10 are fired to generate a pressurized propellant gas and a forward cylinder or barrel 26 containing a plunger 28 which is driven through a forward working stroke in the barrel by the propellant gas pressure. A spring 30 returns the plunger to the rear end of its working stroke after firing. Plunger 28 has a forward reduced shank 32 which slides in a forward sleeve portion 34 of the barrel 26. The front end of this sleeve portion is open.

Referring to FIG. 8, the breech mechanism 24 has a breech cylinder 36 rotatable in a breech frame 38 including a handgrip 40 and a firing strap 42. Cylinder 36 contains chambers 44 which open laterally through the cylinder circumference and endwise through the front and rear cylinder ends. These chambers have a cross-sectional shape matching that of the gas generating charge 10. Within the handgrip 40 are magazines 46, 48 for containing a number of the charges 10. The upper ends of these magazines have infeed openings to the cylinder 36 through which the charges are urged against the cylinder by springs 50 in the lower ends of the magazines. The magazines have upper access openings, closed by hinged covers 52, 54 through which the charges 10 are inserted into the magazines.

Each cylinder chamber 44 is rotatable in the direction of the arrow in FIG. 9, through infeed, firing, and ejection positions. In infeed position, the chambers register with the infeed openings to the magazines 46, 48, as do the two lower chambers in FIG. 8, to permit infeed movement of charges 10 from the magazines into the chambers, in the manner described in my prior U.S. Pat. No. 2,865,126. Each cylinder chamber 44, when in firing position, is located under and has open side closed by the firing strap 42, as illustrated by the upper chamber in FIG. 8. In this firing position, each cylinder chamber is axially aligned with and opens forwardly to a passage 56 leading to the rear end of the tool plunger barrel 26. Rotation of each chamber 44 from firing to infeed position occurs through the ejection position, wherein the chamber registers with an ejection opening 58 in the breech frame 38.

Embodied in the breech mechanism 24 is a conventional trigger actuated mechanism (not shown) including a trigger 60 for rotating the cylinder 36 stepwise through the cylinder chamber infeed, firing and ejection positions. Each actuation of the trigger 60 rotates one chamber, containing a charge 10, from infeed position to firing position where the charge is fired in the manner to be explained, and another chamber from firing position, through ejection position where the jacket 14 of the fired charge is ejected back to infeed position to receive a fresh charge.

The tool 12 may have an electrical firing means 60 (FIG. 9) for firing the charges 10 in firing position. This firing means includes an electrical propellant igniter 62 mounted in the breech frame 38, at the rear of the breech cylinder 36 and on the axis of the breech passage 56, so as to be disposed in ignition relation to the propellant 20 of a charge located in firing position within the cylinder chamber 44. This igniter is effective, when energized, to ignite the expanded propellant of the charge in firing position through the rear open end of the jacket 14 of the charge. Igniter 62 may be a spark, hot wire, or other ignition means capable of igniting the propellant of the charge and, in this description, is assumed to be a hot wire. For example, the igniter may be a spark generator of a non-electrical type.

The hot wire igniter 62, of FIG. 9 is energized by a firing circuit 64 including a trigger switch 66, safety switch 68, and battery 70 connected in electrical series with the igniter, as shown in FIG. 10. Trigger switch 66 is a normally open switch which is mounted in the breech frame 38 for closure by depression of the trigger 60 to rotate a breech cylinder chamber 44 to firing position in such a way that the switch closure occurs after arrival of the chamber in firing position. Safety switch 68 is a normally open switch mounted at the front end of the tool barrel 26 and includes a work engaging member 72 projecting forwardly of the barrel. The safety switch is closed by pressing the tool against a workpiece to depress the switch member 72 rearwardly relative to the barrel. Battery 70 is mounted in the breech frame 38 and is accessible for replacement by removing a threaded battery retaining cap 74.

From the description to this point, it will be understood that each actuation or depression of the trigger 60 rotates a breech chamber 44 and its contained gas generating charge 10 to firing position. Assuming that the safety switch 68 is closed by pressing the tool against a workpiece, depression of the trigger also energizes the igniter 62 to fire the charge in firing position by closure of the trigger switch 66. The pressurized gas generated by the fired charge enters the rear end of the tool barrel 26 through the passage 56 and drives the plunger 28 through a forward working stroke in the barrel. After firing, the plunger is returned rearwardly by its spring 30. The plastic jacket 14 of the charge seals the breech during firing. After firing sufficient leakage space exists to permit return of the plunger by its spring.

As understood earlier, the tool of the invention may be designed for various uses. The particular tool shown is a fastener driving tool, specifically a nail driver, mounting on its barrel 26 a replaceable nail magazine 76. This nail magazine feeds a nail to a nail positioning means (not shown) in the barrel in front of the plunger 28 each time the plunger retracts for driving of the nail into a workpiece by the plunger during its next working stroke. This nail magazine and nail positioning means are conventional and hence need not be further described.

Figure 3:
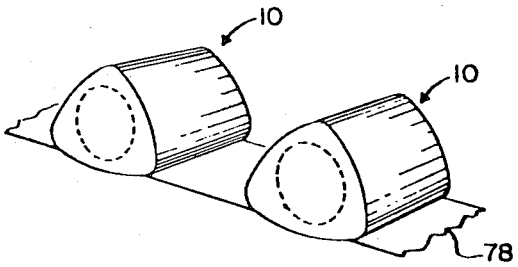
FIG. 3 illustrates belted or attached charges according to the invention.

In some cases, a tool according to the invention may be designed for use with belted or attached gas generating charges. FIG. 3 illustrates such belted charges. In this case, the charge 10 described earlier are adhesively bonded to a feed belt or web 78 constructed of paper or other suitable material. The charges are spaced along the belt in accordance with the circumferential spacing between the breech cylinder chambers of the tool.

Figure 4:
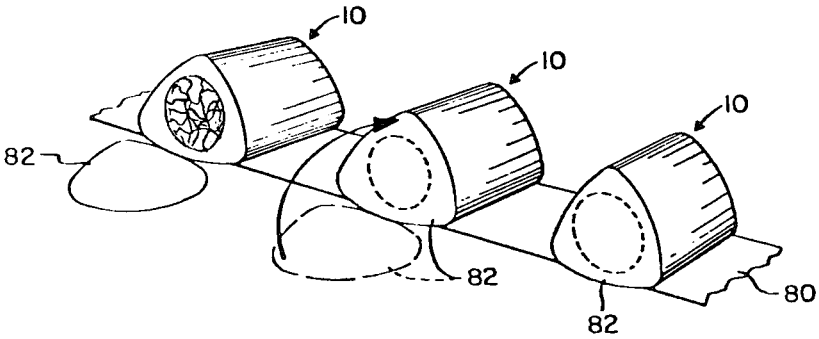
FIG. 4 illustrates a modified version of the belted charges.

As noted earlier, the open ends of the propellant chambers of the charges 10 may be closed by seals. FIG. 4 illustrates modified belted charges wherein the feed belt or web 80 has integral flaps 82 along its edges which may be folded against and bonded to the ends of the charges to form the propellant chamber seals.

Figure 5:
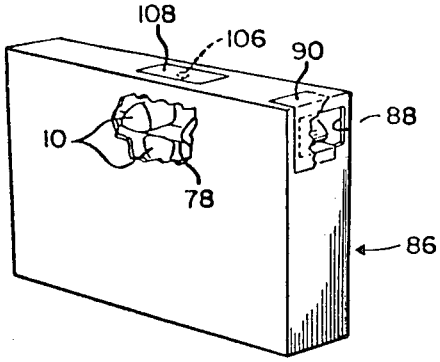
FIG. 5 illustrates a magazine for holding the belted charges.

The belted charges of FIGS. 3 and 4 may be stored in a magazine 86 (FIG. 5) adapted for attachment to a tool. The belted charges are preferably placed in the magazine in aligned arrangement with the propellant openings all facing in the same direction for purposes of safety. The belt 80 with its attached charges 10 may be withdrawn from the magazine through an exit opening 88 in the magazine. This opening may be sealed by a strip of pressure sensitive tape 90 or the like which also anchors the leading end of the belt to permit feeding of the belt into the tool.

As noted earlier, another aspect of the invention is concerned with the fabrication and packaging of the present gas generating charges. According to the present fabricating and packaging technique, for safety purposes the charges are preferably fabricated and packaged in a storage container, such as magazine 86, all while their propellant is still in moist state and the propellant is then dried in its jacket or case which may be inside in the container, after which the latter is hermetically sealed. Fabrication of the charges may be accomplished, for example, by extruding a long tube of plastic having the desired cross-section of the charge jackets, filling the tube with lightly compressed or substantially uncompressed propellant fibres in a moist state, and then slicing the tube into individual charges. Alternatively, the jackets may be formed first by extruding and slicing a long tube of plastic or by injection molding the jackets, after which the jackets may be filled with the moist propellant fibres. The propellant may be in other expanded forms, such as in expanded porous paste form or porous felt, but is preferably in substantially noncompressed fibrous form to provide the large surface area in contact with air to enable the mass of fibres to be easily ignited by a spark or electric ignition.

After packaging of the completed but still moist charges in the storage container, the propellant is dried by placing the container in a suitable drying atmosphere. The container is provided with one or more vent openings 106 (FIG. 5) to permit escape of the moisture released from the propellant. After drying, the container is hermetically sealed, as by sealing the vent openings with tape 108. This safe method of handling the charges virtually eliminates any possibility of ignition of the highly inflammable propellant during the fabricating and packaging operations. The storage container will be sized to receive the charges with a close fit in their endwise direction such that even if ignition of the propellant of a charge some-how occurs in the container, its jacket will prevent ignition of the other charges.

The quantity of burnable nitrocellulose propellant determines the total energy produced by the charge, and different energy levels are required to drive different size nails into woods of different densities. The maximum pressure produced during burning is a function of the loading density of the propellant in the jacket since the rate of burning is a function of the surface area in contact with oxygen, or the degree of porosity. It has been determined that for normal use in driving nails into medium density woods, a peak gas pressure of about 17,000 psi is desired and this is obtained using a loading density of about 132.29, within a desired range of about 100 to 150.

For driving smaller nails, an average charge of 2.2 grains, by weight, has been found effective whereas an average heavier charge of 2.8 grains has been used for driving larger nails, [where grain weight per pound is computed as 7000 grains per pound]. These two sizes or weights of propellant have been used to drive a complete range of sizes of nails; the smaller weight being used to drive nails up to 8 penny nails and the larger size used for up to 16 penny nails.

For ease in loading of the propellant, ready ignition without a primer, and retention of the propellant within the jacket without a binder, a random mixture of different lengths of nc fibres have been used, with fibres ranging in length from the shortest length of about 0.005 inches to 0.02 inches. A somewhat greater range of different lengths may also be used.

The total average weight of the entire charge including the casings or jackets and propellant are about 350 of such charges per pound.

The casings are preferably molded of polypropylene, employing about 75% virgin material and 25% regrinded material. The regrinded material is obtained by regrinding expended charge casings or jackets as well as other scrap materials using this plastic.

As previously discussed, it is desired to provide a very low cost charge using naturally occurring material that is substantially as found in nature with very little additional processing or manufacturing costs. One of the manufactured materials that may be eliminated is a separate primer to ignite the propellant. The longer fibre nc material is more readily ignited by an externally produced spark or flame than the shorter fibre since its packaged porosity or surface area is greater and a primer is not required to break up or separate the material as in a compacted propellant using powder or a very short fibre. Additionally, the longer fibre nc is more self-retaining inside of the casing once it is inserted and does not usually require sealing the ends of the casing opening to retain the propellant inside. However, the longer fibre nc material is somewhat more difficult to load into the casings than the shorter fibres. Therefore a random mixture of longer and shorter fibres nc is preferred to satisfy all requirements.

In an alternative construction, the propellant may be primarily comprised of the shorter length fibres with a small quantity of the longer fibres being inserted at the ignitable end of the charge to serve as an igniting primer, and to help retain the shorter length fibres inside of the casing. As a further alternative, the propellant employed may be a mixture of different lengths, or may be comprised of the shorter length fibres with pensive primer inserted at the ignitable end. One inexpensive primer is obtained by spraying a dryable liquid primer material over the ends of the charges after they are loaded. Liquid spraying of a primer over the ends also provides a seal for the jacket when the spray material dries, to assist in retaining the propellant within its casing. A lacquer made of nitrocellulose, such as tetracene, may be used for this purpose.

An additional advantage of employing such a seal over the ends of the jackets is to improve the ignitable characteristics of the charge in the presence of moisture, or a moisture laden atmosphere. Although it has been found that nitrocellulose propellant can hydroscopically receive up to a few percent of moisture and still be satisfactorily ignited, the use of an end seal, or end primer seal as described can further improve this characteristic.

For ease in loading the propellant into the casing, it is preferred to wet the nitrocellulose. For the longer fibres, a slurry mixture using up to 50% water has been satisfactorily used, and for shorter fibres, a slurry using as much as 90% water, or 95% water, or even 99% water has been used. As previously described the charges are later dried before use. The nitrocellulose is preferably made of wood pulp fibres, cotton linters, or cotton batting that has been nitrated. The nitration is performed by a standard process of applying concentrated nitric acid to the fibres in a desired range of 12.6% to 13.3%.

Ignition of the propellant has been performed using an electrostatic spark having energy from 0.013 to 0.5 joules, or by a piezo-electric generator spark, or by a spark created by impacting a flint with steel. The longer fibre propellant has been successfully ignited by flint and steel even when whetted by as much as 5% moisture.

As an alternative manner of sealing the ends of the propellant, a coating material, such as "KRYLON" may be used as well as various types of elastomeric adhesives. These may be sprayed on as a vapor, or the charges may be brushed or dipped into the liquid and allowed to dry.

What is claimed is:

1. An open chamber gas generating charge for an open chamber gas powered tool, comprising:

a plastic jacket of noncircular cross section containing an opening for propellant extending longitudinally throughout and through the ends of the jacket, a nitrocellulose propellant disposed within said opening, said nitrocellulose being characterized as being substantially in its naturally occuring form, substantially free of mixture with material other than that normally combined with nitrocellulose in nature, and in noncompressed expanded form within said jacket, said nitrocellulose comprised of fibres of wood pulp or cotton linters of random lengths in the range of 0.004 to 0.05 inches and at nitration level in the range of 10 to 15%.

2. In the charge of claim 1, the loading density of propellant within the jacket expressed in grams per cubic centimeter being in the range of 100 to 150 to produce a maximum pressure during burning of about 16,000 to 20,000 pounds per square inch.

3. In the charge of claim 1, the maximum pressure during burning of a charge having a loading density of 100 to 150 grams per cc., being about 17,000 psi for a time period of about one tenth millisecond.

4. In the charge of claim 1, a preferred loading density propellant to opening in the jacket being about 130 grams per cc., and employing a propellant weight of about 3 grains for driving nails.

5. In the charge of claim 1, the loading density of propellant within the jacket expressed in grams per cubic centimeter being 132.29.

6. In the charge of claim 1, said plastic jacket having a substantially uniform triangular cross-section along its length and a substantially concentrically disposed triangular shaped opening in cross-section along its length.

7. In the charge of claim 1, a primer ignition material disposed within said opening at the ignitable end of said charge.

8. In the charge of claim 1, said primer ignition material comprising long fibre nitrocellulose material.

9. In the charge of claim 1, a seal closing the end of said opening in the charge, said seal comprising a thin layer of ignitable material applied in liquid form over the end by one of spraying, dipping, and brushing of the liquid over the propellant.

10. In the charge of claim 9, said seal material comprised of essentially nitrocellulose.

11. An open chamber gas generating charge for firing in an open chamber device comprising:

a polypropylene jacket of triangular cross-section along its length having a concentric triangularly shaped opening extending throughout and through the ends of the jacket, a propellant disposed within said opening comprised of fibres of nitrocellulose material substantially in its naturally occurring form and substantially free of mixture with material other than that normally combined with cellulose found in nature, the loading density of said propellant within said jacket being in the range of 100 to 150 grams per cubic centimeter and ignitable by an externally produced source.

* * * * *